US005201409A

United States Patent [19]

Martin et al.

[11] Patent Number: 5,201,409

[45] Date of Patent: Apr. 13, 1993

[54] VANDAL RESISTANT PUSH BUTTON ASSEMBLY

[75] Inventors: Adolf Martin, Glenview; Richard A. Gregory, Chicago, both of Ill.

[73] Assignee: Inevntio AG, Hergiswil, Switzerland

[21] Appl. No.: 577,454

[22] Filed: Sep. 4, 1990

[51] Int. Cl.[5] ..... H01H 13/70; H01H 9/02

[52] U.S. Cl. ..... 200/345; 200/296; 200/294; 200/341

[58] Field of Search ..... 200/345, 296, 293, 294, 200/308, 309, 341, 333, 294; 174/54, 52.1, 53, 66

[56] References Cited

U.S. PATENT DOCUMENTS

| | | | |
|---|---|---|---|
| 3,102,173 | 8/1963 | Damon | 200/296 X |
| 3,364,330 | 1/1968 | Bassani | 200/296 |
| 3,367,206 | 2/1968 | Moody | 200/345 X |
| 3,619,475 | 11/1971 | Bailey | 174/66 |
| 3,663,780 | 5/1972 | Golbeck | 200/524 X |
| 4,417,113 | 11/1983 | Saito et al. | 200/302.2 |
| 4,480,163 | 10/1984 | Morris et al. | 200/331 |
| 4,822,963 | 4/1989 | Martin | 200/296 |

FOREIGN PATENT DOCUMENTS

| | | |
|---|---|---|
| 2355367 | 2/1978 | France . |
| 412045 | 11/1966 | Switzerland . |
| 588572 | 1/1978 | U.S.S.R. . |

*Primary Examiner*—Henry J. Recla
*Assistant Examiner*—David J. Walczak
*Attorney, Agent, or Firm*—William J. Clemens

[57] ABSTRACT

A vandal resistant push button assembly has a guide ring attached to a mounting plate spaced from a face plate such as an indicating and announcing device or a modular wall assembly of an elevator car. The guide ring has a first shoulder which cooperates with a snap ring engaging a first annular groove formed in the guide ring for retaining the ring in an opening formed in the mounting plate. There is play between the periphery of the opening in the mounting plate and the outer diameter of the guide ring such that the guide ring can be aligned with respect to an opening in the face plate and the snap will cover the gap defined by the play. A push button slidably extends through the guide rings on first and second guide surfaces to actuate a switch and a second shoulder formed on the push button engages a stop surface on the guide ring to prevent further travel in the actuation direction. Spring forces originating from the switch press the push button forward to a rest position at which a spring clip engaging a second groove formed in the push button abuts an end of the guide ring. In this position, a seamless spherical surface is formed by the push button and the guide ring at the face plate.

12 Claims, 1 Drawing Sheet

VANDAL RESISTANT PUSH BUTTON ASSEMBLY

BACKGROUND OF THE INVENTION

The present invention relates generally to push buttons for switches and, in particular, to a vandal resistant push button assembly for elevator systems.

The U.S. Pat. No. 4,822,963 discloses a vandal resistant push button assembly with a push button extending through a guide ring or halo. On the operating side, the push button and the guide ring both have a spherical surface, which surface is bounded by an opening in a face plate mounting the push button assembly. The opening in the face plate is stepped from the operating side to the back or switch side, the stepwise transition forming a circular first shoulder on which the guide ring rests and on which the forces acting toward the switch are transferred to the face plate. Also disclosed is a method for the manufacture of the shoulder by means of embossing (or coining) technology instead of the customary cutting method, which has the advantage that a high mechanical strength is assured even at a relatively small thickness of the face plate.

The guide ring is designed as a tubular member with a second shoulder formed on an outer surface and a third shoulder formed on an inner surface such that the guide ring can be inserted precisely into the face plate opening with the first and second shoulders in contact where the spherical surface of the ring blends without a seam into the adjacent outer surface of the face plate. A wire shaped spring clip engages an annular groove encircling the guide ring and forms a resealable connection between the inner surface of the face plate and the guide ring. The guide ring slidably receives a push button having a fourth shoulder formed thereon for engaging the third shoulder to limit the movement of the push button in the direction of the switch. The switch is designed to bias the push button opposite to the actuation direction wherein a wire shaped spring clip engaging an annular groove encircling the push button abuts the guide ring so that the spherical surface of the push button blends without a seam into the spherical surface of the guide ring.

A disadvantage of above described push button assembly is the expensive manufacture of the face plate. In a first working step, the openings for the guide rings are punched from the face plate. A second working step is required for the embossing of the ends of the openings. Besides this, certain material thicknesses and material hardnesses are necessary for the carrying out of this process. A further disadvantage is the fact that the face plate supporting the switch assembly has to be inserted onto or into existing wall units, which impairs the aesthetic layout of the wall.

SUMMARY OF THE INVENTION

The present invention overcomes the disadvantages of the known devices and provides a vandal resistant push button assembly in a modular construction which can be integrated into existing wall units serving as face plates. The push button assembly according to the present invention includes a guide ring which has an external first shoulder cooperating with a snap ring engaging a first groove formed in the guide ring to retain a periphery of an opening in the mounting plate. An internal cylindrical first guide surface and an internal cylindrical second guide surface along which a push button slides during actuation are formed in the guide ring and also define a stop surface. The push button travel in an actuating direction is limited by the abutment of a second shoulder formed on the push button with the stop surface. The push button operates a switch, wherein spring tension generated by the switch presses the push button to a rest position in the opposite direction until a spring clip engaging a second groove formed in the push button comes to rest at one end of the guide ring.

The advantages achieved by the invention can be seen essentially in the fact, that in spite of low manufacturing costs, the protection against vandalism is improved by an construction not visible from the outside. This construction protects the switch against forceful damage, which again simplifies the material selection for the face plate and increases the design possibilities for the wall units. A further advantage is the fact that the material thickness of the face plates as well as that of the wall units can be chosen independently from the push button assembly and that the face plates as well as the wall units can be manufactured independently from the push button assembly. Besides that, a subsequent fitting of the push button assembly into existing wall units is possible without further difficulty.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
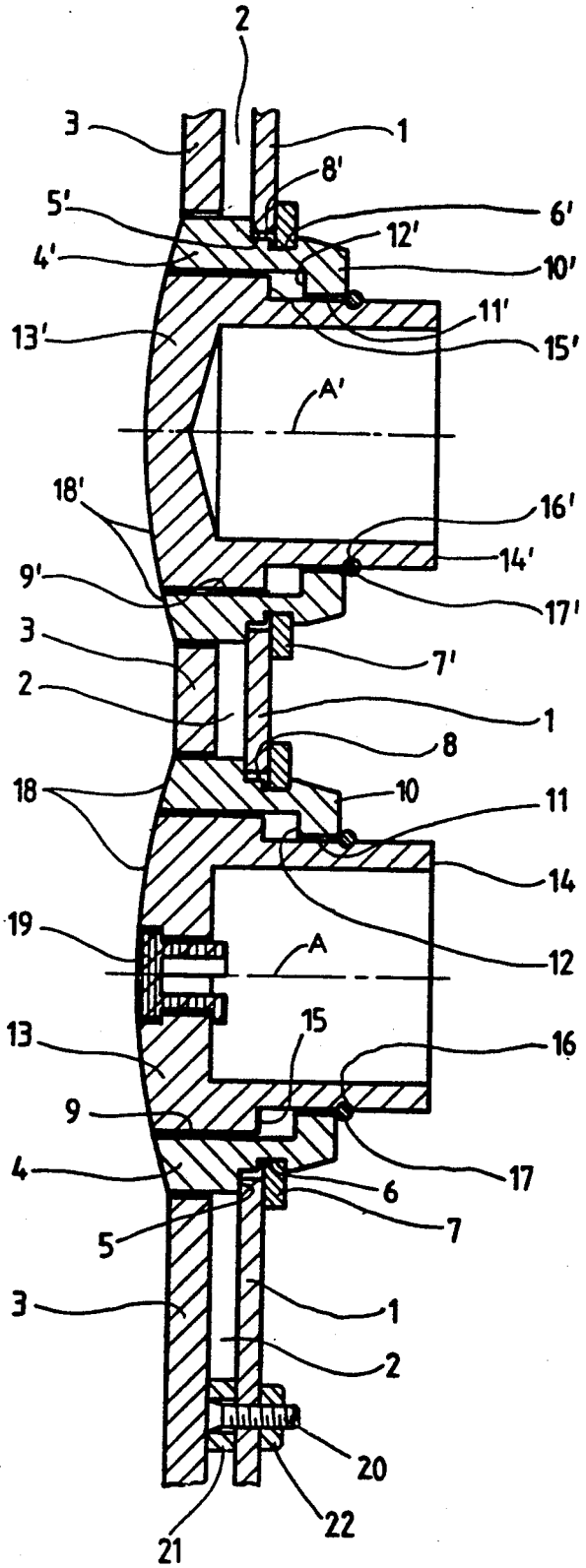
FIG. 1 is a side elevation cross sectional view of a vandal resistant push button assembly according to the invention attached to a mounting plate.

Designated with 1 in the FIG. 1 is a mounting plate which is spaced by a gap 2 from a face plate or a wall unit 3. The mounting plate 1 can be attached to the face plate 3 by any suitable known fastening means. For example, a screw or stud 20 extends from the face plate 3 and through a spacer 21, such as a washer or a bushing, which spacer can be any selected length to bridge the gap 2 and allow different material thicknesses of the face plate 3 to be matched to the push button assembly. The fastening means 20 extends through a aperture formed in the mounting plate 1 and is retained by a nut 22. Typical face plates 3 are the covers of indicating and announcing devices, or modular wall assemblies of elevator cars, or wall panels.

The mounting plate 1, which can be made of sheet steel, and the face plate 3, typically made of stainless steel, each have punched out openings in which guide rings, such as a pair of guide rings 4 and 4', are positioned. The outside cylindrical surface of the guide rings 4 and 4' is stepped down in diameter in an axial direction toward switches (not illustrated) to be actuated. Thus, vertically extending support surfaces in the shape of a pair of first shoulders 5 and 5' are created on the rings 4 and 4' respectively. Formed adjacent to each of the first shoulders 5 and 5' is an associated one of a pair of annular first grooves 6 and 6'.

The distance between the shoulder 5 and the groove 6 is approximately equal to the thickness of the mounting plate 1. The opening in the mounting plate 1 is smaller in diameter than the larger diameter portion of the guide ring 4. Forces acting in the direction of actuation, along a longitudinal axis A of the push button assembly, are transferred to the mounting plate 1 through the abutting first shoulder 5. A disk-shaped snap or retaining ring 7, elastically expandable at its periphery, extends into the first groove 6 and attaches the guide ring 4 to the mounting plate 1 by retaining a periphery of the opening in the mounting plate between the shoulder 5 and the snap ring 7. The punched openings of the mounting plate 1 are dimensioned such that a play 8 is created between the smaller diameter portion of the guide ring 4 and the periphery of the opening in the mounting plate 1. Thus, the guide ring 4 can be aligned with the associated punched opening in the face plate 3 wherein the guide ring extends into and snugly closes the opening in the face plate on the operating side and the dimensions of the snap ring 7 are selected to cover the play 8 in every instance. Similarly, the guide ring 4' is retained by a snap ring 7' extending into an annular groove 6' and play 8' is created between the smaller diameter portion of the guide ring 4' and the periphery of the associated opening in the mounting plate 1.

A larger diameter cylindrical first guide surface 9 extends from a front opening to an internally extending annular flange at the other end 10 of the guide ring 4. The flange defines a smaller diameter second guide surface 11 and an inwardly facing vertical stop surface which serves as a stop for limiting the actuating path of the push button assembly. A push button 13 inserted in the opening in the guide ring 4 slides along the first and second guide surface 9 and 11. With an inner end 14, the push button actuates a switch (not illustrated). The length of the actuating path is determined, at the periphery of the push button 13, depending on the position of a second step shaped shoulder 15 defined between a larger diameter portion associated with the first guide surface 9 and a smaller diameter portion associated with the second guide surface 11. Upon actuation of the push button 13, the second shoulder 15 is displaced to a vertical stop surface 12 formed by the flange of the guide ring 4, whereupon forces acting in direction of the axis A are transferred onto the stop 12 of the guide ring 4. Similarly, the guide ring 4' has a first guide surface 9' and a second guide surface 11' formed by the flange at the other end 10' of the guide ring. A push button 13' slides in the guide ring 4' and has a smaller diameter inner end 14' defining a second shoulder 15' which engages a vertical stop surface 12' on the flange of the ring 4'.

An annular second groove 16 is formed in the smaller diameter periphery of the push button 13, into which groove a wire-shaped spring clip 17 is halfway inserted. Spring forces originating from the switch (not illustrated) force the push button 13 in a longitudinal direction toward the face plate 3 until the spring clip 17 abuts the end 10 of the guide ring 4. In this position, a seamless spherical surface 18 is formed by the spherical face of the push button 13 and the spherical face of the guide ring 4 at the operation side of the face plate 3. Similarly, a spring clip 17' engages an annular second groove 16' formed in the smaller diameter portion of the push button 13' and a seamless spherical surface 18' is formed by the push button and the guide ring 4'.

The push button assembly according to the present invention can have a lens for indicating operating conditions. For example, the push button 13 can include a lens 19 centrally positioned at the spherical surface 18. Although many different materials can be utilized, push button assemblies manufactured of stainless steel or brass provide excellent protection against vandalism.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A vandal resistant push button assembly comprising:

a mounting plate having a front surface and a rear surface, an opening of a predetermined diameter formed therein between said front surface and said rear surface and means for attaching to a rear surface of a face plate;

a guide ring extending through said opening in said mounting plate and having a pair of spaced apart ends and an axially extending opening formed therein between said ends of said guide ring, said axially extending opening having an internal larger diameter cylindrical first guide surface and an internal smaller diameter cylindrical second guide surface connected together by a stop surface, said guide ring having a larger diameter external surface and a smaller diameter external surface connected together by a first step shaped shoulder, said first step shaped shoulder abutting said front surface of said mounting plate and said smaller diameter external surface being smaller in diameter than said opening in said mounting plate by a predetermined width gap, said guide ring having means for removably retaining said guide ring in said opening in said mounting plate;

a push button extending through said axially extending opening in said guide ring and having a generally cylindrical body with a pair of spaced apart ends and an external surface slidably engaging said first and second guide surfaces, said push button having a second step shaped shoulder formed on said external surface and being limited in travel in an actuating direction along an actuation path in said axially extending opening by abutment of said second shoulder with said stop surface on said guide ring; and a spring clip retained on said push button adjacent an inner one of said ends of said push button for limiting travel of said push button in a direction opposite said actuating direction along said actuation path by engagement of said spring clip with one of said ends of said guide ring whereby the other ends of each of said guide ring and said push button form a generally seamless surface and said predetermined width gap permits movement of said guide ring and said push button with respect to said mounting plate in a direction transverse to said actuation path to align said guide ring with an opening in the face plate through which said guide ring and said push button extend when said mounting plate is attached to the rear surface of the face plate.

2. The vandal resistant push button assembly according to claim 1 including a face plate for covering an indicating and announcing device for an elevator and having a front surface and a rear surface to which said mounting plate is attached, said face plate having an opening formed therein for exposing said other ends of said guide ring and said push button at said front surface to form a generally seamless surface.

3. The vandal resistant push button assembly according to claim 1 including a face plate forming a modular wall assembly and having a front surface and a rear surface to which said mounting plate is attached, said face plate having an opening formed therein for exposing said other ends of said guide ring and said push button at said front surface to form a generally seamless surface.

4. The vandal resistant push button assembly according to claim 1 wherein said means for attaching includes fastening means having a selected length for maintaining said mounting plate at a predetermined distance from the rear surface of the face plate, said selected length being determined by a thickness of the face plate.

5. The vandal resistant push button assembly according to claim 4 wherein said fastening means includes at least one screw mounted on the rear surface of the face plate and extending through a removable spacer selected from a plurality of different length spacers abutting the rear surface of the face plate and said front surface of said mounting plate, a length of said removable spacer being determined by a thickness of the face plate.

6. The vandal resistant push button assembly according to claim 1 including a face plate having an operating side and an opening formed therethrough and wherein said guide ring extends into and snugly closes said opening in said face plate on said operating side.

7. The vandal resistant push button assembly according to claim 1 wherein said means for retaining includes an annular groove formed in an outer surface of said guide ring and a disk-shaped snap ring elastically expandable along its periphery and removably engaging said groove, said snap ring abutting said rear surface of said mounting plate and removably retaining said guide ring in said opening in said mounting plate.

8. The vandal resistant push button assembly according to claim 7 wherein said snap ring covers said predetermined width gap.

9. The vandal resistant push button assembly according to claim 1 wherein said other ends of said guide ring and said push button have said generally seamless surface formed as a spherical surface.

10. A vandal resistant push button assembly comprising:

a face plate having front and rear surfaces and an opening formed therein;

a mounting plate having front and rear surfaces and an opening formed therein;

fastening means of a selected length attaching said mounting plate to and maintaining said front surface of said mounting plate at a predetermined distance from said rear surface of said face plate, said predetermined distance being determined by a thickness of said face plate;

a guide ring attached to said mounting plate and extending through said opening in said mounting plate and into said opening in said face plate, said guide ring having a pair of spaced apart ends and an axially extending opening formed between said ends and having an internal larger diameter cylindrical first guide surface and an internal smaller diameter cylindrical second guide surface connected together by a stop surface;

a push button having a generally cylindrical cross section extending through said axially extending opening formed in said guide ring and slidably engaging said first and second guide surfaces, said push button having a pair of spaced apart ends and a generally cylindrical exterior surface with a shoulder formed thereon and being limited in travel in an actuating direction along an actuation path in said axially extending opening by abutment of said shoulder with said stop surface on said guide ring; and a spring clip retained on said push button for limiting travel in a direction opposite said actuating direction along said actuation path by engagement of said spring clip with an inner one of said ends of said guide ring, said spring clip being positioned adjacent one of said ends of said push button whereby the other ones of said ends of said guide ring and said push button form a generally seamless surface with said front surface of said face plate.

11. The vandal resistant push button assembly according to claim 10 wherein said fastening means includes at least one screw mounted on said rear surface of said face plate and extending through a spacer selected from a plurality of different length spacers, said spacer abutting said rear surface of said face plate and said front surface of said mounting plate.

12. A vandal resistant push button assembly comprising:

a face plate having front and rear surfaces and an opening formed therein;

a mounting plate having front and rear surfaces and an opening formed therein;

fastening means attaching said mounting plate to and maintaining said mounting plate at a predetermined distance from said rear surface of said face plate, said fastening means including at least one screw mounted on said rear surface of said face plate and extending through a spacer selected from a plurality of different length spacers, said spacer butting said rear surface of said face plate and said front surface of said mounting plate;

a guide ring having an exterior surface and a pair of ends with an axially extending opening formed therein extending between said ends, said guide ring being attached to said mounting plate and extending through said opening formed in said mounting plate, said guide ring having one of said ends extending into said opening formed in said face plate, said axially extending opening having an internal larger diameter cylindrical first guide surface and an internal smaller diameter cylindrical second guide surface connected together by a stop surface, said guide ring having a fist shoulder formed on said exterior surface and an annular first groove spaced from said first shoulder and formed in said exterior surface;

a disk-shaped snap ring elastically expandable along its periphery and engaging said annular first groove formed in an exterior surface of said guide ring, said first shoulder and said snap ring cooperating with said front and rear surfaces of said mounting plate at a periphery of said opening in said mounting plate to retain said guide ring;

a push button extending through said aperture in said guide ring and having a generally cylindrical exterior surface slidably engaging said first and second guide surfaces, said push button having a second shoulder formed on said exterior surface of said push button and being limited in travel in an actuating direction along an actuation path in said axially extending opening by abutment of said second shoulder with said stop surface on said guide ring, said push button having an annular second groove formed in said exterior surface of said push button adjacent one of said ends; and a spring clip retained in said annular second groove formed in said push button for limiting travel in a direction opposite said actuating direction along said actuation path by engagement of said spring clip with one of said ends of said guide ring whereby the other ends of said guide ring and said push button form a generally seamless surface with said front surface of said face plate.

* * * * *